United States Patent [19]

Fina

[11] Patent Number: 4,991,504

[45] Date of Patent: Feb. 12, 1991

[54] INK DUCT FOR A PRINTING MACHINE

[75] Inventor: Raffaele Fina, Lausanne, Switzerland

[73] Assignee: De la Rue Giori S.A., Lausanne, Switzerland

[21] Appl. No.: 436,628

[22] Filed: Nov. 15, 1989

[30] Foreign Application Priority Data

Dec. 15, 1988 [CH] Switzerland ..... 4639/88

[51] Int. Cl.[5] ..... B41F 31/06; B41F 31/18

[52] U.S. Cl. ..... 101/208; 101/363

[58] Field of Search ..... 101/207, 208, 210, 204, 101/364, 363, 152

[56] References Cited

U.S. PATENT DOCUMENTS

| | | | |
|---|---|---|---|
| 1,165,160 | 12/1915 | Dunnet | 101/210 |
| 1,893,148 | 1/1933 | Page | 101/210 |
| 2,301,535 | 11/1942 | Green | 101/210 |
| 2,442,700 | 6/1948 | Luehrs | 101/364 |
| 2,525,363 | 10/1950 | Luehrs | 101/364 |
| 3,635,161 | 1/1972 | Leanna | 101/208 X |
| 3,831,517 | 8/1974 | Wagner | 101/208 |
| 4,419,932 | 12/1983 | Cappel | 101/210 X |

FOREIGN PATENT DOCUMENTS

| | | | |
|---|---|---|---|
| 2497153 | 7/1982 | France . | |
| 924401 | 4/1963 | United Kingdom | 101/210 |

*Primary Examiner*—Clifford D. Crowder

*Attorney, Agent, or Firm*—Griffin, Branigan & Butler

[57] ABSTRACT

The ink duct is separated by at least one separating wall which is fastened to the base and is formed from two metal plates (4, 5), fastened at a distance from each other and between which a plastic intermediate plate (6) is mounted with a tight fit and so that it can be displaced and tilted and is guided by a pin (17) which is fastened between the plates and passes through an oblong hole in the said intermediate plate (6). This intermediate plate (6) has a front edge (6a) which has the shape of an arc of a circle corresponding to the periphery of the ink duct cylinder. In the use position, it is pressed against this periphery by two spring pins (9,10; 12,13) which act on its rear edge so as to ensure a leaktight contact with the said ink duct cylinder. A positioning pin (18), which is fastened to the said plate (6), allows it to be pulled into the withdrawn position, where it may be locked. The leak-tightness with the base of the ink duct is achieved by a plastic sealing strip (25, 26) provided on the lower edge of the metal plates.

12 Claims, 3 Drawing Sheets

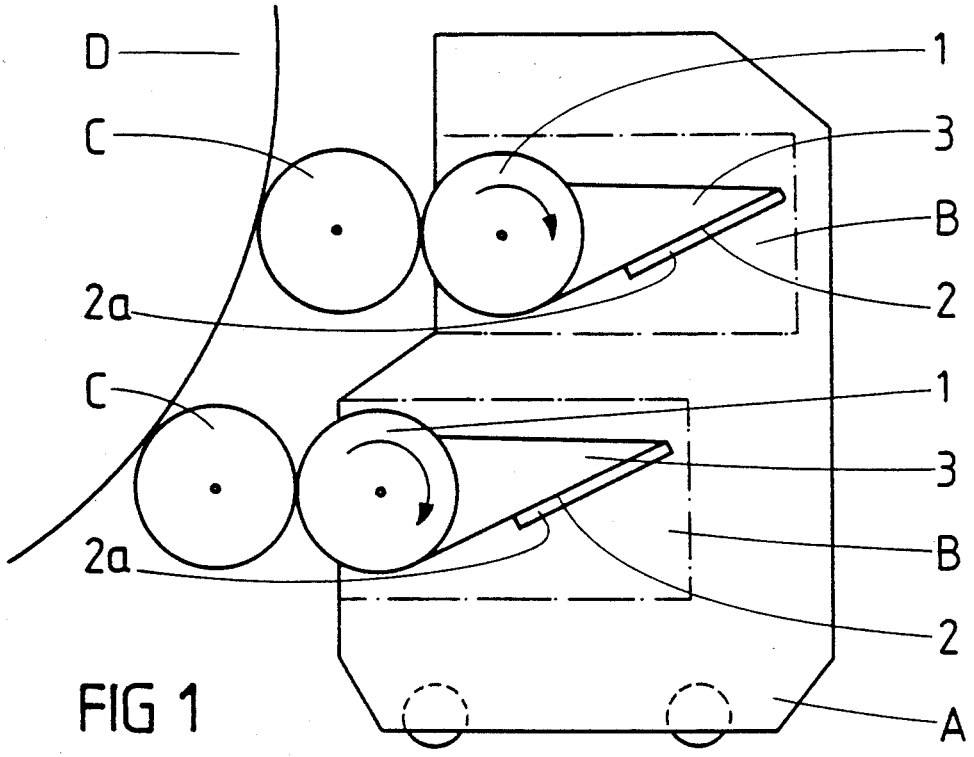
FIG 1
FIG 5
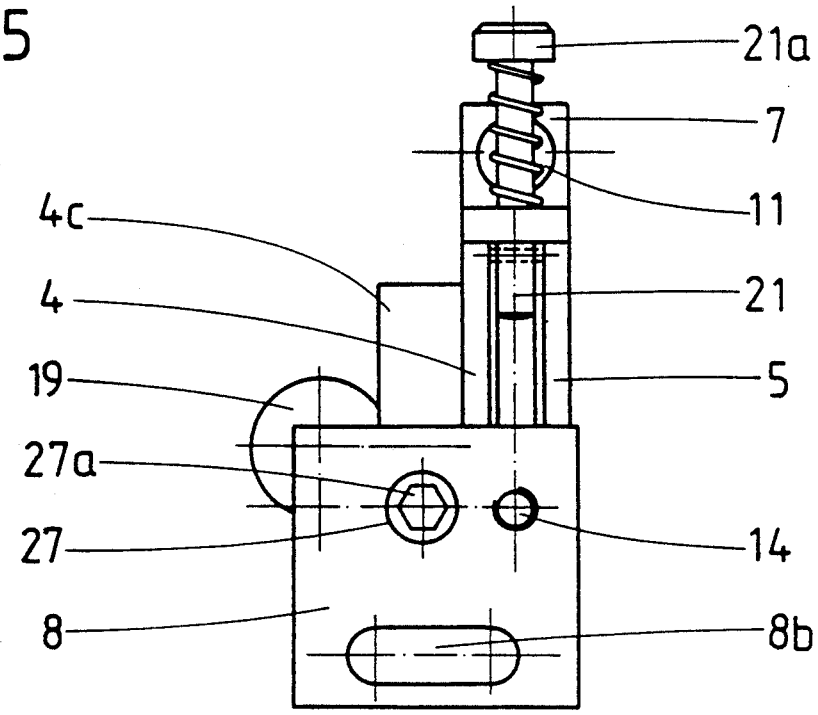

INK DUCT FOR A PRINTING MACHINE

FIELD OF THE INVENTION

The present invention relates to an ink duct for a printing machine according to the preamble of claim 1.

PRIOR ART

Ink ducts of this type are known, for example from the U.S. Pat. No. 2.525.363. It is sometimes desirable to use the same ink duct, filled with inks of different colors, to ink simultaneously the ink duct cylinder with two or more juxtaposed colors and to do this means must be present to separate the different inks in the ink duct.

The present invention proposes to create an ink duct having separation means which ensure a perfect leak-tightness between themselves and, on the one hand, the ink duct cylinder and, on the other hand, the base.

SUMMARY OF THE INVENTION

In order to overcome this problem, the ink duct according to the present invention has the features of the defining clause of claim 1.

BRIEF DESCRIPTION OF THE DRAWINGS

The attached drawings show, by way of example, an embodiment of the invention.

FIG. 1 diagrammatically illustrates an inking device with two ink ducts inking two associated inking rollers which are intended to ink the plate-cylinder of an intaglio printing machine.

FIG. 5 is a rear view of the separating wall in accordance with the arrow V of FIG. 2.

DESCRIPTION OF THE PREFERRED EMBODIMENT

Figure 3:
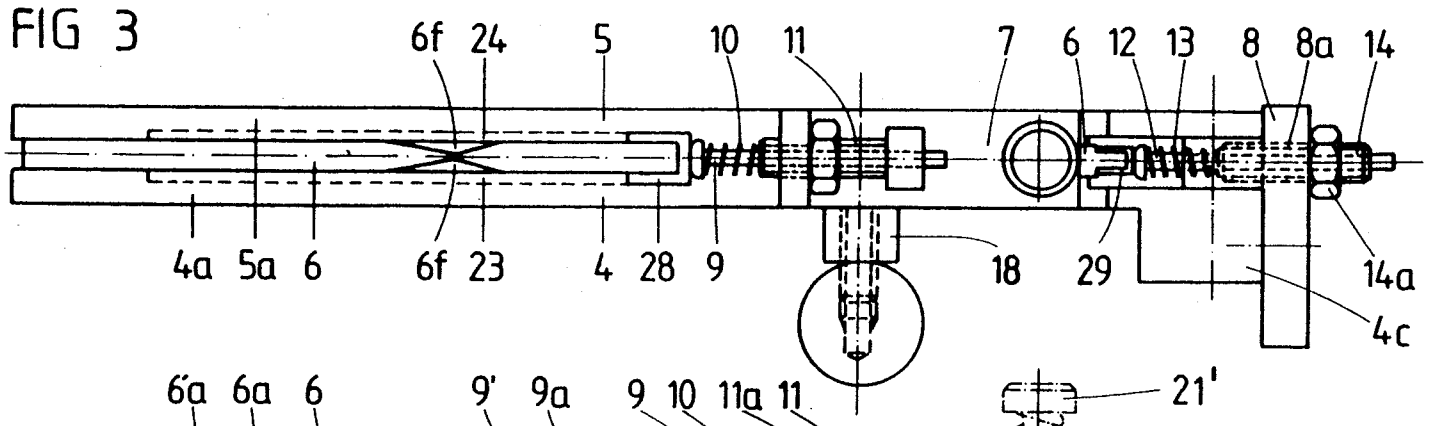
FIG. 3 is a view from above of the wall according to FIG. 2.

FIG. 1 shows an inking device with two super-posed ink ducts of the type used for intaglio machines. It is formed from an inking carriage A which supports two superposed frames B, each equipped with an ink duct formed from a base 2 and from two side walls 3 which cooperate with an ink duct cylinder 1. The base 2 is formed from a metal sheet whose front edge touches the ink duct cylinder 1 and this metal sheet is, in general, carried by a support 2*a*. To illustrate an application of this ink duct, inking rollers C have been shown which are associated with each ink duct and ink the intaglio printing plates, not illustrated, mounted on the plate-cylinder D.

The separating wall according to the invention, which is intended to be fastened to the base 2 of the ink duct so as to allow this ink duct to be used with two inks of different colors is illustrated in FIGS. 2 to 5. This separating wall consists of two metal plates 4, 5, of approximately the same shape, fastened at a distance from each other and between which a plastic intermediate plate 6 is mounted with a tight fit, which plate can be displaced and tilted relative to the former plates according to a limited movement, as will be explained below.

The two metal plates 4, 5 exhibit, at the front, an inclined edge 4*a*, 5*a* which terminates in a slightly curved end intersecting their lower edge 4*b*, 5*b* at an acute angle.

Figures 4, 6, 7:
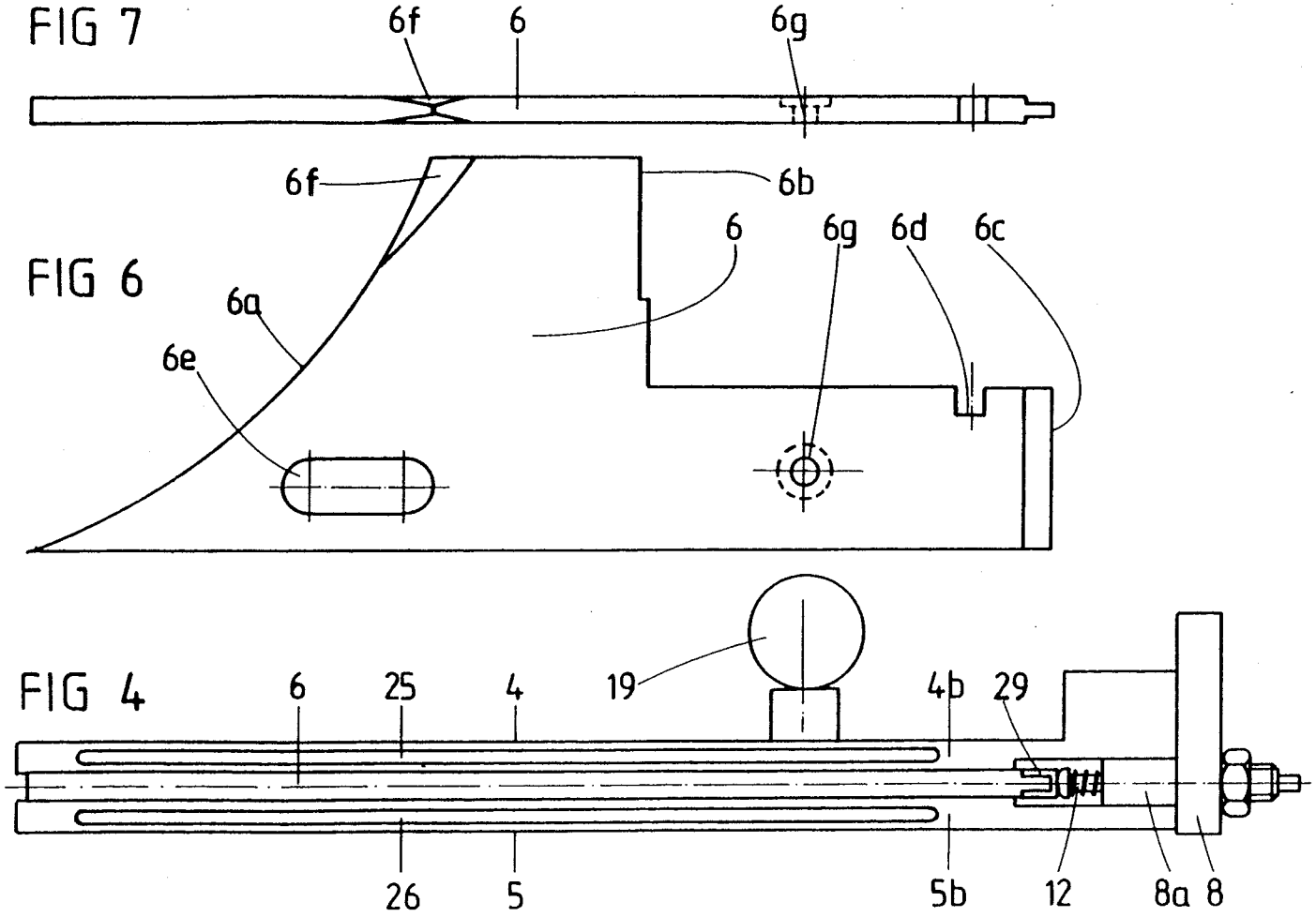
FIG. 4 is a view from below of the wall according to FIG. 2.
FIG. 6 is a side view of the plastic intermediate plate of the separating wall.
FIG. 7 is a view from above of the intermediate plate according to FIG. 6.

The intermediate plate 6, illustrated separately in FIGS. 6 and 7, in turn exhibits, at the front, a front edge 6*a* in the shape of an arc of a circle, the radius of curvature of which corresponds to that of the periphery of the ink duct cylinder 1 to which it is to be tightly applied. This front edge 6*a* terminates towards the top in two beveled facets 6*f* (FIG. 3). The rear edge of the intermediate plate 6 is formed from two stepped vertical sections 6*b*, 6*c*. The intermediate plate 6 furthermore exhibits towards the front an oblong hole 6*e*, which serves to guide it, towards the rear a hole 6*g* for fastening a positioning pin 18 and, in the horizontal wall which connects the two vertical sections 6*b* and 6*c*, a recess 6*d*.

The fastening together of the two metal plates 4 and 5 is ensured, in the upper part, by a first, right-angled fastening element 7, equipped with a rib 7*a* which serves as a brace fitting between them, the assembly being achieved by three fastening screws 15 which pass through the said rib 7*a* and the metal plates. In the lower and rear part, this fastening is achieved by a second fastening element 8 likewise equipped with a rib 8*a* which serves as a brace, having the same thickness as the first, and also fitting between the two metal walls, the assembly being achieved by two screws 16 which pass through the said rib 8*a* and the metal plates 4, 5. In this location the metal plate 4 exhibits a wider part 4*c*, and the fastening element 8 is, in addition, screwed onto the metal plate 4 by a screw 27*a* which passes through a hole 27 in the element 8 and penetrates the said wider part 4*c* wherein it is screwed (FIG. 5).

The clamping of the metal plates 4, 5 is adjusted so that the intermediate plate 6 may be displaced with a tight fit between the two metal plates 4 and 5. The guidance of the intermediate plate 6 between the two metal plates 4 and 5 is ensured by a metal pin 17 which is fastened between the said plates and passes through the oblong hole 6*e* formed in this intermediate plate 6.

Figure 2:
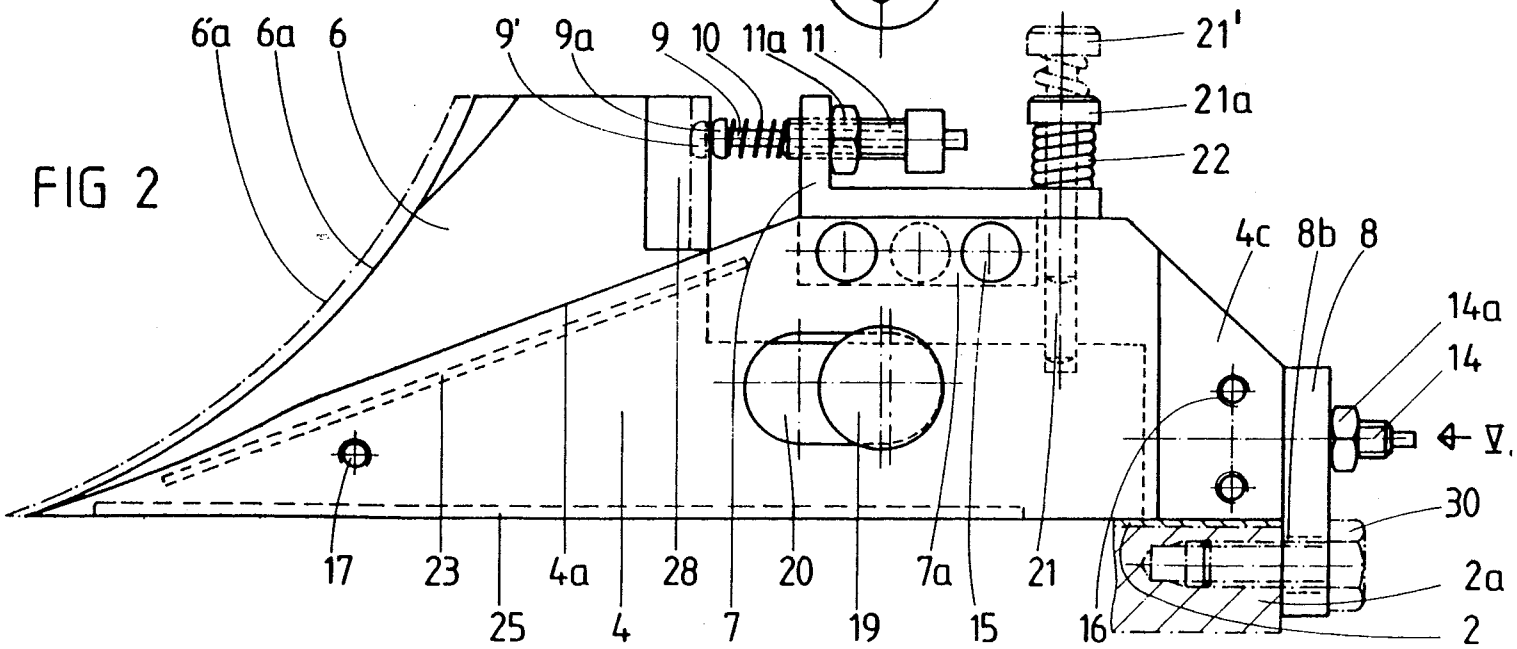
FIG. 2 is a side view of a separating wall according to the invention which is mounted in at least one of the ink ducts according to FIG. 1.

In order to create a leaktight contact between the front edge 6*a* of the intermediate plate 6 and the periphery of the ink duct cylinder 1, pressure means are provided which act on the rear edge of the said intermediate plate 6, at two different heights, so as to set it in the use position, as illustrated by dashed lines 6'*a* in FIG. 2 These means consist of a first telescopic pin 9 with spring 10 which bears with its head 9*a* against the vertical section 6*b* of the intermediate plate 6. The telescopic pin 9 with spring 10 is held on the vertical part of the element 7 by a hollow screw 11, with lock nut 11*a*. This pin 9 can slide in the said hollow screw 11 and is surrounded by the spring 10 which bears, towards the front, against the said head 9*a* of the pin 9 and, towards the rear, against a spring collar located at the end of the screw 11 The spring is compressed by the position of this screw 11 so as to produce the force required to press the edge 6*a* firmly against the ink duct cylinder and to obtain a satisfactory leaktightness. In the withdrawn position illustrated in solid lines in FIG. 2, the telescopic pin 9 penetrates the said hollow screw 11.

A second telescopic pin 12 with spring 13, which is held on the second fastening element 8 by means of a hollow screw 14, with lock nut 14*a*, is provided so as to push the intermediate plate 6 likewise forwards into the use position by bearing, under the action of the spring 13, against the rear vertical section 6*c* of the intermediate plate 6. U-shaped metal bearings are preferably provided on the intermediate plate 6 at the place where the ends of the pins 9, respectively 12, are applied, namely a bearing 28 fastened onto the vertical section 6*b*, and a bearing 29 fastened onto the rear vertical section 6*c* respectively.

The positioning pin 18 fastened in the hole 6*g* of the intermediate plate 6 passes through an oblong slot 20 formed in the metal plate 4, the end of this pin which juts out from the separating wall being equipped with a handle 19 by means of which the printer may retract the intermediate plate 6 by hand and disengage it away from the ink duct cylinder 1. Furthermore, since the base 2 of the ink duct is inclined in the work position as illustrated in FIG. 1, the handle 19 does not, of course, become immersed in the ink which reaches to a level below this handle. Means for locking the intermediate plate 6 in the withdrawn position are also provided, consisting of a locking pin 21 which is mounted axially displaceably in the horizontal section of the fastening element 7, this pin 21 being equipped with a head 21*a*, and its end being provided so as to fit into the recess 6*d* of the intermediate plate 6 in order to lock the latter when it is in the withdrawn position. The portion of the pin 21 between the head 21*a* and the fastening element 7 is surrounded by a return spring 22 which tends to keep the said pin 21 raised.

The leaktightness between the separating wall and the base 2 of the ink duct is ensured by leaktight sealing strips 25, 26 which are inserted in the grooves formed in the lower edges of the metal plates 4 and 5, in parallel to the latter.

The leaktightness between the intermediate plate 6 and the metal plates 4 and 5 in the upper part of the separating wall is likewise achieved by leaktight sealing strips 23, 24 which are inserted in the grooves formed on the inner face of the metal plates 4 and 5 along their inclined edge 4*a*, 5*a*.

The separating wall is also equipped with means for fastening to the base 2 of the ink duct and respectively to the support 2*a* shown in part by dashed lines, only in FIG. 2. These means consist of a screw 30 which passes through an oblong slot 8*b* (FIG. 5) formed in a portion of the fastening element 8, which juts out from the bottom of the separating wall, and which is screwed into the support 2*a*, the major axis of the oblong slot 8*b* being parallel to the base 2.

In order to set the separating wall in the use position illustrated, as already mentioned, by dashed lines in FIG. 2, the printer pulls the head 21*a* of the locking pin 21 upwards into the position 21', thus freeing this pin 21 from the recess 6*d*. The intermediate plate 6 is then subjected to the action of the springs 10 and 13 which push it forwards by means of the pin 9, the curved front edge, in its position 6'*a* of the said plate 6, coming to be applied against the periphery of the ink duct cylinder 1, the pin 9 then being in the position 9'.

The pressure exerted upon the intermediate plate 6 by the two pressure means, in this instance the springs 10 and 13, ensures that this plate hugs the periphery of the ink duct cylinder 1 perfectly and this leaktightness is maintained even if the periphery is somewhat worn. The leaktightness with the base is ensured, independently of this provision, by the sealing strips 25, 26 of the metal plates, the leaktightness of the wall with the base thus not being affected if a small displacement of the intermediate plate 6, caused by a slight modification of the periphery of the ink duct cylinder 1, takes place during operation.

The other sealing strips 23, 24 prevent the ink from penetrating down between the metal plates 4 and 5. The upper part of the front edge 6*a* of the intermediate plate 6, with its two beveled facets 6*f*, allows the ink which has remained on the peripheral wall of the ink duct cylinder 1 turning in the direction of the arrow indicated in FIG. 1 to be effectively separated on either side of the said intermediate plate 6 once the said ink duct cylinder has made contact with the inking roller C.

In its rest position or when disassembling the ink duct, the printer pulls the handle 19 backwards, which, as it moves, draws the intermediate plate 6 counter to the force of the springs 10 and 13, and once the intermediate plate 6 has reached its withdrawn position (FIG. 5), he pushes the screw 21 downwards, counter to the spring 22, until its end penetrates the recess 6*d* and thus locks the intermediate plate 6 in this withdrawn position. In the withdrawn position which has just been described, the force exerted by the springs 10 and 13, which are tightly compressed, causes the locking pin 21, whose end engages the recess 6*d*, to be held by friction in this recess counter to the action of the return spring 22.

The invention is not limited to the embodiment which has just been described and alternative embodiments, in particular pressure or locking means, could be provided without, in so doing, going beyond the scope of the invention.

I claim:

1. An ink duct for a printing machine comprising an ink duct cylinder, a base formed by a metal sheet whose front end touches the ink duct cylinder, and side walls in contact with the base and the ink duct cylinder, wherein at least one separating wall is provided which is fastened to the base and is formed from two metal plates, fastened at a distance from each other, from a plastic intermediate plate mounted between these two metal plates so that it can be displaced and tilted, this intermediate plate having a front edge which has the shape of an arc of a circle corresponding to the periphery of the ink duct cylinder, and from pressure means which act on this intermediate plate and push it towards the periphery of the ink duct cylinder so as to create a leaktight contact between them, while the leaktightness between the base of the ink duct and the separating wall is ensured by a plastic sealing strip provided on the lower edge of the metal plates said pressure means including springs applied to a rear edge of said intermediate plate for pushing it against said ink duct cylinder, said intermediate plate having a manual actuating means affixed thereto and being accessible for drawing the intermediate plate backwardly against action of the springs for removing the intermediate plate from the ink duct cylinder, and said ink duct further including a blocking means for locking the intermediate plate in its withdrawn position.

2. The ink duct as claimed in claim 1, wherein the intermediate plate is held with a tight fit between the two metal plates and is guided between them by a metal pin which is fastened to the said plates and passes through an oblong hole in the said intermediate plate.

3. The ink duct as claimed in claim 1, wherein said springs are applied at different heights to two sections of the rear edge of said intermediate plate 4. The ink duct as claimed in claim 1, wherein the means for fastening together the two metal plates consist, on the one hand, of a first, right-angled upper fastening element, equipped with a rib which serves as a brace between the two plates, and, on the other hand, of a second, lower and rear fastening element, which is likewise equipped with a rib which serves as a brace between the two plates, these two elements carrying telescopic spring pins which form part of the pressure means, the lower fastening element serving at the same time to fasten the separating wall to the base, said springs acting on said spring pins.

5. The ink duct as claimed in claim 1, wherein the front edge, which has the shape of an arc of a circle, of the intermediate plate has a beveled upper end.

6. The ink duct as claimed in claim 1, wherein a recess is formed on an upper edge of the intermediate plate and, above this recess, there is provided a locking pin of said blocking means mounted axially displaceably in an element fastened to the said metal plates and wherein this locking pin, in a low position, engages the said recess so as to lock the said intermediate plate in a withdrawn position from the ink duct cylinder and, in a high position, frees said intermediate plate.

7. The ink duct as claimed in claim 6, wherein the rear edge of the said intermediate plate is formed from two stepped sections, the recess being formed in an edge which connects these two stepped sections.

8. The ink duct as claimed in claim 1, wherein the metal plates have an inclined front edge from which the front part of the intermediate plate juts out.

9. The ink duct as claimed in claim 8, wherein the leaktightness between the intermediate plate and the metal plates is achieved at the upper part of the separating wall by sealing strips inserted in grooves formed on inner faces of these metal plates along their inclined front edge.

10. An ink duct for a printing machine comprising an ink duct cylinder, a base formed by a metal sheet whose front edge touches the ink duct cylinder, and side walls in contact with the base and the ink duct cylinder, wherein at least one separating wall is provided which is fastened to the base and is formed from two metal plates, fastened at a distance from each other, from a plastic intermediate plate mounted between these two metal plates so that it can be displaced and tilted, this intermediate plate having a front edge which has the shape of an arc of a circle corresponding to the periphery of the ink duct cylinder, and from pressure means which act on this intermediate plate and push it towards the periphery of the ink duct cylinder so as to create a leaktight contact between them, while the leaktightness between the base of the ink duct and the separating wall is ensured by a plastic sealing strip provided on the lower edge of the metal plates, wherein the means for fastening together the two metal plates consist, on the one hand, of a first, right-angled upper fastening element, equipped with a rib which serves as a brace between the two plates, and, on the other hand, of a second, lower and rear fastening element, which is likewise equipped with a rib which serves as a brace between the two plates, these two elements carrying telescopic spring pins which form part of the pressure means, the lower fastening element serving at the same time to fasten the separating wall to the base.

11. An ink duct for a printing machine comprising an ink duct cylinder, a base formed by a metal sheet whose front edge touches the ink duct cylinder, and side walls in contact with the base and the ink duct cylinder, wherein at least one separating wall is provided which is fastened to the base and is formed from two metal plates, fastened at a distance from each other, from a plastic intermediate plate mounted between these two metal plates so that it can be displaced and titled, this intermediate plate having a front edge which has the shape of an arc of a circle corresponding to the periphery of the ink duct cylinder, and from pressure means which act on this intermediate plate and push it towards the periphery of the ink duct cylinder so as to create a leaktight contact between them, while the leaktightness between the base of the ink duct and the separating wall is ensured by a plastic sealing strip provided on the lower edge of the metal plates, wherein a recess is formed on an upper edge of the intermediate plate and, above this recess, there is provided a locking pin mounted axially displaceably in an element fastened to the said metal plates and wherein this locking pin, in a low position, engages the said recess so as to lock the said intermediate plate in a withdrawn position from the ink duct cylinder and, in a high position, frees said intermediate plate.

12. The ink duct as claimed in claim 11, wherein the rear edge of the said intermediate plate is formed from two stepped sections, the recess being formed in an edge which connects these two stepped sections.

* * * * *